US011761279B2

(12) United States Patent
Tonti et al.

(10) Patent No.: US 11,761,279 B2
(45) Date of Patent: Sep. 19, 2023

(54) MULTI-STAGE PROPELLANT CHARGE FOR DOWNHOLE SETTING TOOLS

(71) Applicant: INNOVEX DOWNHOLE SOLUTIONS, INC., Houston, TX (US)

(72) Inventors: Nick Tonti, Houston, TX (US); Jeffery Kitzman, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 17/738,140

(22) Filed: May 6, 2022

(65) Prior Publication Data

US 2022/0356773 A1 Nov. 10, 2022

Related U.S. Application Data

(60) Provisional application No. 63/184,954, filed on May 6, 2021.

(51) Int. Cl.
*E21B 23/04* (2006.01)
*E21B 23/06* (2006.01)

(52) U.S. Cl.
CPC ..... *E21B 23/0414* (2020.05); *E21B 23/065* (2013.01)

(58) Field of Classification Search
CPC .... E21B 23/065; E21B 23/0414; E21B 23/04; E21B 43/1185
See application file for complete search history.

(56) References Cited

U.S. PATENT DOCUMENTS 3,002,559 A * 10/1961 Hanes ..... E21B 23/065 166/123
3,024,843 A * 3/1962 Hanes ..... E21B 23/065 166/212
3,266,575 A * 8/1966 Owen ..... E21B 23/065 166/120
4,306,499 A * 12/1981 Holmes ..... F42B 3/18 102/202.4
5,230,287 A * 7/1993 Arrell, Jr. ..... F42B 3/195 102/202.5
5,316,087 A * 5/1994 Manke ..... E21B 23/065 166/381
5,775,426 A * 7/1998 Snider ..... E21B 43/11852 166/308.1
6,925,937 B2 * 8/2005 Robertson ..... E21B 29/02 102/202
8,904,933 B2 * 12/2014 Nudo ..... F42B 3/195 102/202.5
9,453,382 B2 9/2016 Carr et al.
10,107,054 B2 * 10/2018 Drury ..... F42B 5/192
10,927,627 B2 * 2/2021 Eitschberger ..... E21B 23/0412
11,053,783 B2 * 7/2021 Montoya Ashton ..... E21B 23/0414
11,204,224 B2 * 12/2021 McNelis ..... F42D 1/045
2018/0120066 A1 * 5/2018 Khatiwada ..... E21B 23/065
(Continued)

*Primary Examiner* — Kipp C Wallace
(74) *Attorney, Agent, or Firm* — MH2 TECHNOLOGY LAW GROUP LLP

(57) ABSTRACT

An actuator for setting a downhole tool comprises a first propellant configured to be ignited by an igniter, and a second propellant configured to be ignited by combustion of the first propellant, the first propellant abutting the second propellant such that the first propellant covers an axial end of the second propellant. The first propellant is configured to combust more quickly than the second propellant.

25 Claims, 4 Drawing Sheets

(56) References Cited

U.S. PATENT DOCUMENTS

| | | | | |
|---|---|---|---|---|
| 2020/0032601 | A1* | 1/2020 | Nguyen | C06B 25/34 |
| 2020/0189791 | A1* | 6/2020 | Dregger | B29C 53/8091 |
| 2020/0291737 | A1* | 9/2020 | Arrell, Jr. | E21B 23/0417 |
| 2022/0282960 | A1* | 9/2022 | Stovall | F42D 1/04 |

* cited by examiner

MULTI-STAGE PROPELLANT CHARGE FOR DOWNHOLE SETTING TOOLS

CROSS-REFERENCE TO RELATED APPLICATIONS

This application claims priority to U.S. Provisional Patent Application No. 63/184,954, which was filed on May 6, 2021 and is incorporated herein by reference in its entirety.

BACKGROUND

A variety of downhole tools are employed in the oil and gas field to accomplish various tasks. For example, one type of downhole tool is a plug, which may be used to isolate one zone of the well from another. Such a plug is generally run into the well as part of a tool string, e.g., wireline, slickline, etc. When the plug has been deployed to the desired location, the plug is set, e.g., radially expanded, so that it is anchored in place and seals with a surrounding tubular.

Setting downhole tools (e.g., plugs, packers, etc.) often includes axially compressing a setting assembly of the tool, which causes the radial expansion of sealing members. A setting tool is typically provided for this purpose and is run into the well as part of the tool string, e.g., adjacent to the downhole tool. In one illustrative example, the downhole tool might include a mandrel, with slips and seals positioned around the mandrel. The setting tool sets the downhole tool by engaging the mandrel and applying an upwardly-directed force thereon. The mandrel is generally connected to a shoe or another lower collar, which travels with the mandrel and thus transmits this upward force to the slips and seals positioned around the mandrel. Meanwhile, an outer sleeve of the setting tool presses downward on an upper collar positioned around the mandrel, and thus the slips and seals between the shoe and the upper collar are axially compressed and radially expanded. The slips may bite into the surrounding tubular, anchoring the position of the downhole tool, while the elastomeric seals expand radially outward and seal the annulus between the surrounding tubular and the downhole tool. Further, the setting forces may cause the setting tool to release from the downhole tool, such that the tool string may then be withdrawn from the well, leaving the downhole tool in place.

There are several different ways to actuate the setting tool, so as to set the downhole tool. One type of setting tool relies on combustion, i.e., ignition of a propellant charge that drives a piston downwards while an outer sleeve around the piston is held stationary. This generates the push-pull force relationship between the inner mandrel (pull) and the outer sleeve (push) that sets the downhole tool. Such combustion setting tools are used with success in the field; however, they may be somewhat unreliable at times, and applying the desired amount of force over the desired about of time on the plug, using the propellant, sometimes proves difficult in practice.

SUMMARY

Embodiments of the disclosure include an actuator for setting a downhole tool. The actuator includes a first propellant configured to be ignited by an igniter, and a second propellant configured to be ignited by combustion of the first propellant, the first propellant abutting the second propellant such that the first propellant covers an axial end of the second propellant. The first propellant is configured to combust more quickly than the second propellant.

Embodiments of the disclosure include a method that includes igniting a first propellant by applying an electrical current to an igniter. Igniting the first propellant causes the first propellant to combust, which causes a second propellant to combust. The first propellant covers an axial end of the second propellant, and the first propellant is configured to combust more quickly than the second propellant.

Embodiments of the disclosure include a setting tool for actuating a downhole tool, the setting tool including a charge assembly that includes a charge housing, a cylindrical sleeve positioned in the charge housing, a first propellant positioned in the cylindrical sleeve and having an outer diameter surface that contacts an inner diameter surface of the cylindrical sleeve, and a second propellant positioned in the cylindrical sleeve and having an outer diameter surface that contacts the inner diameter surface of the cylindrical sleeve. The first propellant entirely covers an end surface of the second propellant, the first propellant is positioned axially between an igniter and the second propellant, the second propellant occupies a greater volume than the first propellant occupies, and the first propellant is configured to combust more rapidly than the second propellant. The setting tool also includes a piston assembly including a piston that is configured to slide in response to a pressure applied by combustion of at least the second propellant.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
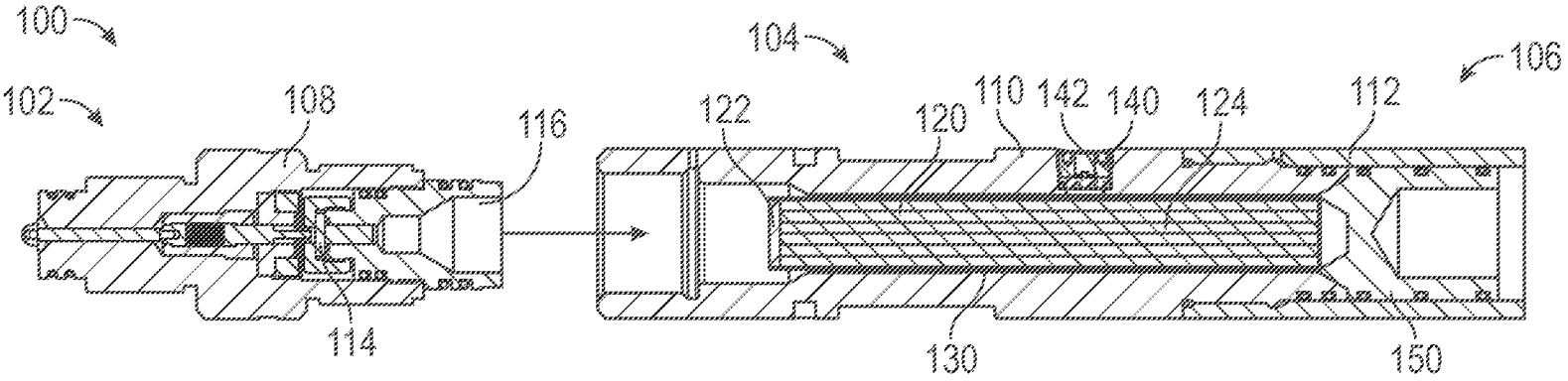
FIG. 1 illustrates a side, cross-sectional, partially-exploded view of a setting tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional, partially-exploded view of a setting tool 100 for setting a downhole tool (e.g., a packer, bridge plug, frac plug, valve, or the like), according to an embodiment. The setting tool 100 generally includes an ignition assembly 102, a charge assembly 104, and a piston assembly 106.

The ignition assembly 102 includes an igniter housing 108, which may be connected to one end of a charge housing 110 of the charge assembly 104. In turn, the charge housing 110 may be connected on a piston housing 112 of the piston assembly 106. The ignition assembly 102 includes an igniter 114, which may include an electrically-resistive element and a highly-combustible charge (e.g., black powder). The igniter housing 108 may include a flame port 116, which may be received into the charge housing 110, and may be configured to direct a flame initiated in the igniter 114 towards the charge assembly 104.

The charge assembly 104 includes a cylindrical, multi-stage propellant charge 120. The charge 120 may include a first propellant 122 and a second propellant 124. The first propellant 122 may be positioned between the second propellant 124 and the igniter 114. Further, the first and second propellants 122, 124 may be axially abutting, e.g., with the first propellant 122 entirely covering an axial end of the second propellant 124. As such, a flame emitted by the igniter 114, if it travels axially to the charge 120, reaches the first propellant 122 and is prevented from directly impinging upon the second propellant 124. This may ensure that the first propellant 122 is ignited by the flame, even if the flame is not directed at precisely the middle of the charge 120.

Figure 2A:
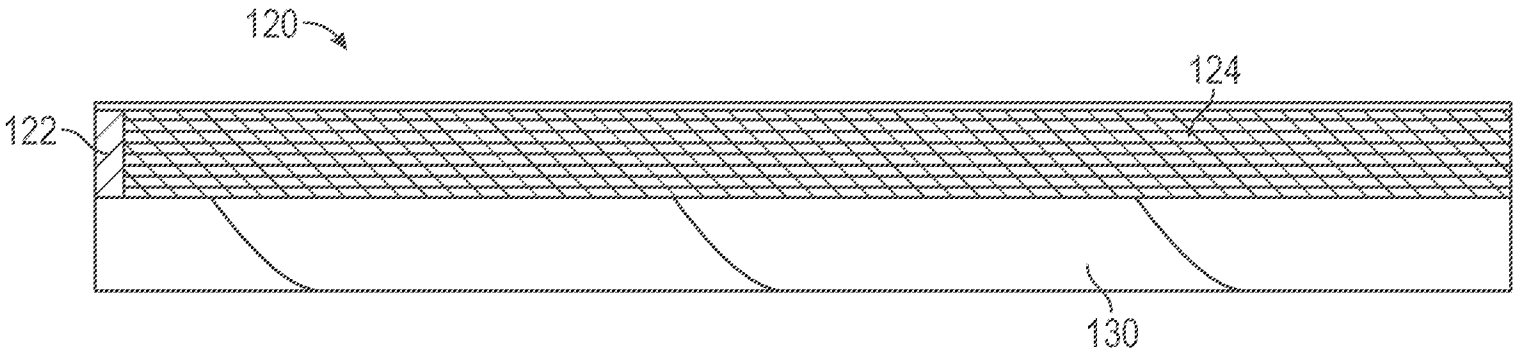
FIG. 2A illustrates a side, half-sectional view of a charge of the setting tool, according to an embodiment.

The first and second propellants 122, 124 may be positioned (e.g., pressed into and together) in a cylindrical sleeve 130, as also shown in FIG. 2A. Further, the first and second propellants 122, 124 may both extend to the inner diameter of the cylindrical sleeve 130, such that the first and second propellants 122, 124 each individually fill an entire cross-sectional area of the cylindrical sleeve 130 where the respective propellants 122, 124 are positioned. That is, in this embodiment, the first propellant 122 has an outer diameter surface that presses against (contacts) the inner diameter surface of the cylindrical sleeve 130, e.g., in all radial directions, and likewise, in this embodiment, the second propellant 124 has an outer diameter surface that extends to, e.g., presses against and contacts, the inner diameter surface of the cylindrical sleeve 130, e.g., in all radial directions. In other words, from a perspective of a first axial end of the cylindrical sleeve 130, only the first propellant 122 is visible, and from a perspective of a second axial end of the cylindrical sleeve, opposite to the first axial end, only the second propellant 124 is visible.

Figure 2B:
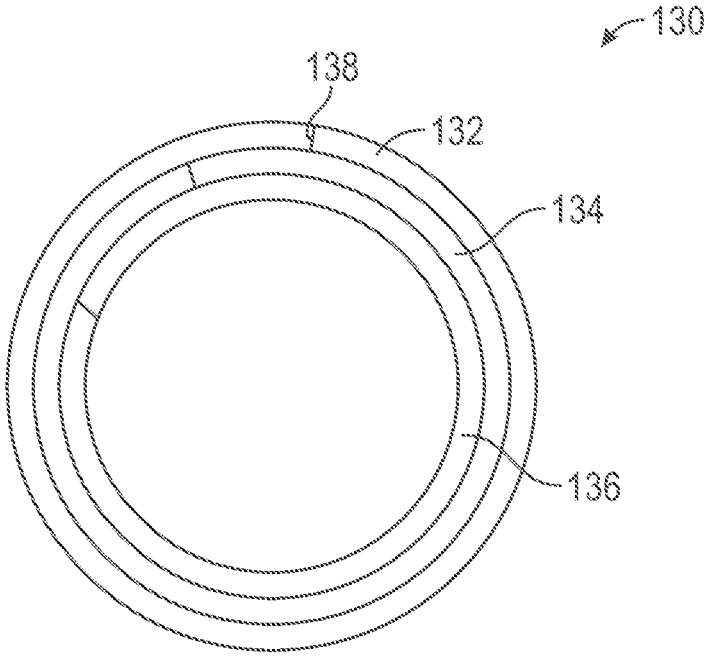
FIG. 2B illustrates an end view of a sleeve of the charge, according to an embodiment.

The cylindrical sleeve 130 may be combustible, and thus may combust along with the first and second propellants 122, 124. In some examples, the sleeve 130 may be helically wrapped, e.g., from a paper-based material. In another embodiment, as shown in FIG. 2B, the sleeve 130 may be a wrapped by multiple circumferential layers 132, 134, 136 (three layers are shown by way of example, with potentially many more, thinner layers being employed). Each of the layers 132-136 includes an axially-extending seam 138, with seams 138 of radially-adjacent layers 132-136 being circumferentially (angularly) offset.

Referring again to FIGS. 1 and 2A, the cylindrical sleeve 130 may provide an interior volume in which the first and second propellants 122, 124 are positioned. The second propellant 124 may occupy a majority of this volume, with a balance of the volume at least substantially occupied by the first propellant 122. In some embodiments, the second propellant 124 may occupy between about 75% and about 99%, about 80% and about 97%, or about 85% and about 95% of the interior volume, e.g., about 90%. In some embodiments, the first propellant 122 may occupy between about 1% and about 25%, between about 3% and about 20%, or between about 5% and about 15% of the volume, e.g., about 10%.

The first propellant 122 may be configured to combust at a greater rate (more rapidly) than the second propellant 124; that is, for equivalent amounts of the first propellant 122 and the second propellant 124, the first propellant 122 fully combusts over a shorter period of time. For example, the first propellant 122 may include a greater than or equal to proportion (weight percentage) of oxidizing agent, at least prior to ignition, and/or a stronger oxidizing agent, than the second propellant 124. In at least one embodiment, the first propellant 122 may include potassium perchlorate as the oxidizing agent, and the second propellant 124 may include potassium nitrate as the oxidizing agent. In other embodiments, the first and/or second propellants 122, 124 may contain other oxidizing agents. Further, the first propellant 122 may include a greater percentage of oxidizing agent (e.g., by weight) than the first propellant 124 does, e.g., whether or not the same oxidizing agent is used between the two. For example, the first propellant 122 may include between about 60% and about 90%, by mass, of oxidizing agent. For example, the second propellant 124 may include between about 50% and about 80%, by mass, of oxidizing agent.

The first and second propellants 122, 124 may each also include a carbon source, e.g., to sustain the combustion process. In some embodiments, the first and second propellants 122, 124 may employ the same carbon source, but in other embodiments, may employ two different carbon sources. The carbon source may be fibrous, which may give the propellants 122, 124 a relatively rigid consistency (rather than a powder or crumbling consistency) that tends to maintain its form when the first and second propellants 122, 124 are packed into the sleeve 130.

Referring again to FIG. 1, the charge housing 110 includes a pressure port 140 extending therein, e.g., in communication with the interior thereof that contains the propellants 122, 124 (e.g., positioned within the sleeve 130). The pressure port 140 may include a plug 142, which may block the pressure port 140 during use. When the tool 100 is removed from a well, e.g., after used, the plug 142 may be released from the pressure port 140 to relieve pressure. In some embodiments, the plug 142 may also provide a one-way, pressure-relief valve which may vent gas from within the charge housing 110 so as to prevent damage thereto.

The piston assembly 106 may include a piston 150 that is slidably positioned in the piston housing 112. The piston 150 may be configured to slide in response to a pressure differential formed across the piston 150 in an axial direction, parallel to a central longitudinal axis of the tool 100. In an embodiment, as shown, the piston 150 may be on one axial side of the charge 120, and the igniter assembly 102 may be on an opposite axial side of the charge 120, such that the charge 120 is axially between the igniter assembly 102 and the piston 150. Further, the first propellant 122 may be proximal to the igniter assembly 102, and the second propellant 124 may be proximal to the piston 150.

In operation, an electrical current may be supplied to the igniter 114 in order to initiate actuation by the setting tool 100. The electrical current may cause the igniter 114 to ignite the charge therein, creating a flame that is emitted from the flame port 116. The flame impinges on the first propellant 122. Because the first propellant 122 occupies the entire cross-sectional area within the sleeve 130 at the axial end of the charge 120, the likelihood of the flame reaching the first propellant 122 and igniting it is high, higher than if the first propellant 122 only occupied a portion of the end. Once the first propellant 122 ignites, it rapidly combusts and ignites the second propellant 124. The second propellant 124 combusts more slowly, thereby increasing the gas pressure on the piston 150, and generating a pressure differential that presses the piston 150 away from the charge 120 over a period of time. The movement of the piston 150 relative to the piston housing 112 may then be used to push a setting sleeve and a pull an inner body, so as to radially expand (e.g., through axial compression, swaging, etc.) a downhole tool.

Figure 2C:
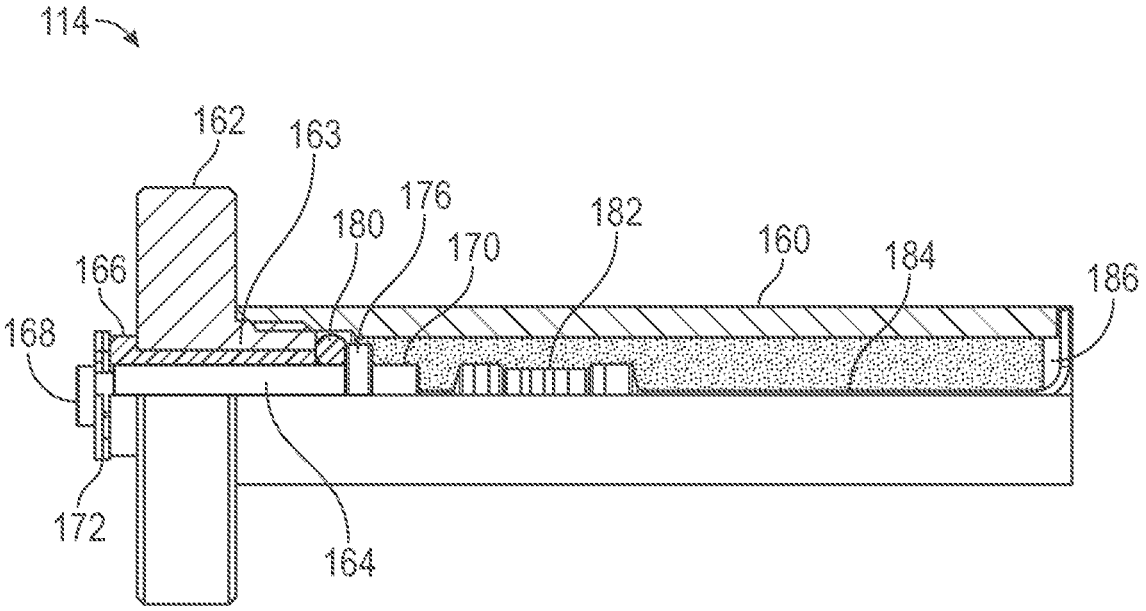
FIG. 2C illustrates a side, half-sectional view of an igniter of the setting tool, according to an embodiment.

FIG. 2C illustrates a side, half-sectional view of the igniter 114, according to an embodiment. The igniter 114 generally includes a sleeve 160 and a head 162. In particular, the head 162 may be partially received into an end of the sleeve 160 and may extend radially outward therefrom. The sleeve 160 may be soldered, crimped, or otherwise secured to the head 162. In a specific example, the sleeve 160 may be threaded onto an axially-extending portion 163 of the head 162.

A conductor 164 may be received through the head 162 and into the sleeve 160. An insulator tube 166, e.g., made from a non-conductive material such as plastic, may be positioned radially between the conductor 164 and the head 162. The conductor 164 may protrude outward from the head 162 and the insulator tube 166. For example, one end 168 of the conductor 164 may provide an external contact, and another end 170 may provide an internal (within the sleeve 160) contact. The end 168 may be secured in place relative to the insulator tube 166 via a fastener, such as a circlip 172. The circlip 172 may, for example, be received in a groove or recess formed in the conductor 164, and may be sized so as to be too large to fit through the insulator tube 166. The conductor 164 may also include or be connected to a shoulder 176, which may also be sized to be too large to fit through the insulator tube 166. The shoulder 176 may be on the reverse side of the insulator tube 166 from the circlip 172. A seal 180 may be positioned between the shoulder 176 and the insulator tube 166 and/or the head 162. Accordingly, pressing the conductor 164 through the insulator tube 166 and securing the conductor 164 using the circlip 172 may also compress the seal 180, and thereby preventing fluid communication along the interfaces between the head 162 and the sleeve 160, the head 162 and the insulator tube 166, and the insulator tube 166 and the conductor 164.

The igniter 114 may further include a resistor 182. The resistor 182 may be electrically connected (e.g., soldered to) to the internal contact provided by the end 170 of the conductor 164. Further, the resistor 182 may be electrically connected to the sleeve 160, e.g., via a wire 184. The wire 184 may, for example, extend axially along a middle of the sleeve 160, before being bent outward and connected (e.g., soldered) to an end of the sleeve 160, opposite to the end that receives the head 162. A plug or "cap" 186 may form a seal with the end of the sleeve 160. The cap 186 may be formed, for example, from an epoxy. The sleeve 160 may contain a charge (e.g. PYRODEX™, black powder, etc.) therein, which is maintained within the sleeve 160 by the cap 186 and the assembly of the head 162, insulator tube 166, and conductor 164. Thus, the charge material may be in contact with the resistor 182 within the sealed ends of the sleeve 160.

In operation, an electrical current may be applied to the conductor 164, e.g., via a contact with the end 168. The current may proceed via the conductor 164 to the resistor 182, and then via the wire 184 to the sleeve 160. The current may then proceed through the sleeve 160, to the head 162, which may be in contact with another metallic or otherwise conductive element, which may be connected to ground. As such, the electrical path to ground may be established through the resistor 182. This may overload the resistor 182, causing it to rapidly heat, which ignites the charge contained in the sleeve 160. Igniting the charge causes a rapid increase in pressure in the sleeve 160, which ejects the cap 186, permitting a flame to be directed out of the end (serving as the flame port) of the sleeve 160. This flame may then be used to ignite the first propellant, as discussed above.

Figure 3:
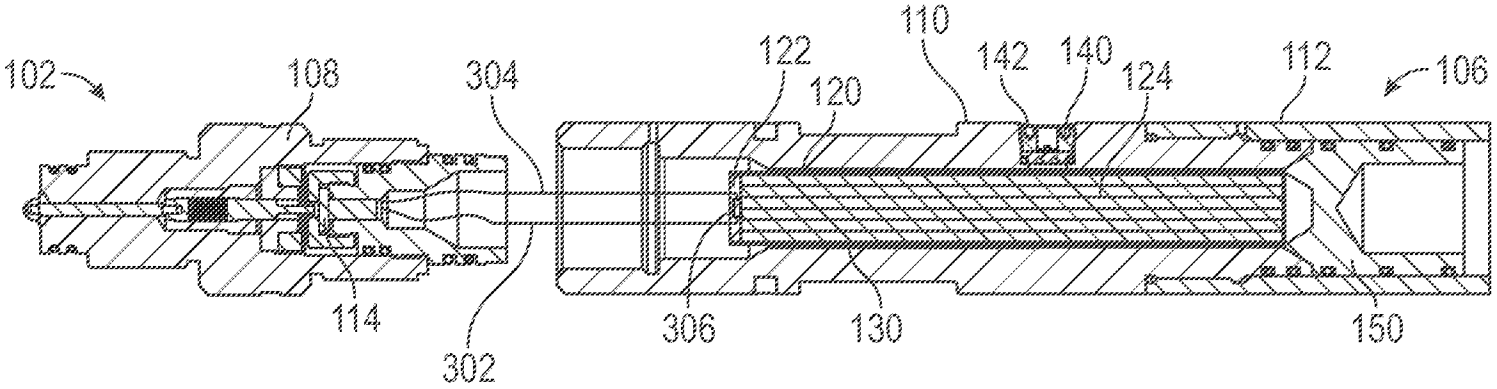
FIG. 3 illustrates a side, cross-sectional view of another embodiment of the setting tool.

FIG. 3 illustrates a cross-sectional view of another embodiment of the setting tool 100. In this embodiment, the igniter assembly 102, discussed above, is omitted, and a direct-ignition assembly 300 is provided instead. The direct-ignition assembly 300 may include two leads (wires) 302, 304 connected to an electrically-resistive element 306, e.g., a wire heater or a resistor. The electrically-resistive element 306 may be positioned on the first propellant 122 or at least partially embedded therein. When an electrical potential across the two wires 302, 304 is applied, a current is generated that heats the electrically-resistive element 306, which then initiates combustion of the first propellant 122. In at least some embodiments, the second wire 304 may be omitted, and the electrically-resistive element 306 may be grounded to the charge housing 110, which may be a conductive metal. In either case, the direct-ignition assembly 300 may not rely on a flame to initiate combustion of the first propellant 122, but may instead directly ignite the first propellant 122 by heating the electrically-resistive element 306.

Figure 4:
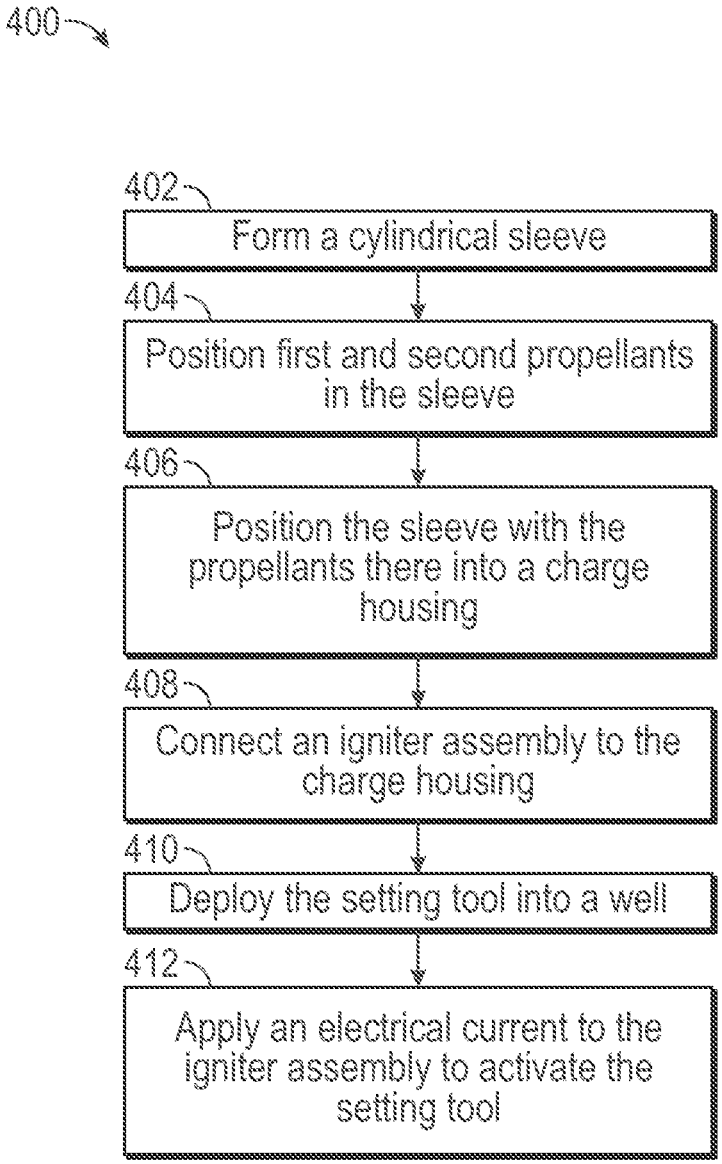
FIG. 4 illustrates a flowchart of a method for actuating a setting tool to set a downhole tool, according to an embodiment.

FIG. 4 illustrates a flowchart of a method 400 for assembling and/or operating a setting tool, such as the setting tool 100 discussed above, according to an embodiment. It will be appreciated that the steps of the method 400 may be performed in the order discussed below, or in any other order, and certain steps may be combined, broken into two or more steps, or performed in parallel, without departing from the scope of the present disclosure. Furthermore, while embodiments of the method 400 may be performed using the setting tool 100, some embodiments of the method 400 may employ other setting tools.

The method 400 includes forming a combustible, cylindrical sleeve 130, as at 402. The sleeve 130 may be formed, for example, by wrapping a plurality of layers 132-136 circumferentially such that seams 138 of the plurality of layers 132-136 are axially extending, with the seams 138 of radially-adjacent layers 132-136 being circumferentially offset from one another. In another embodiment, the sleeve 130 may be formed by helically wrapping one or more layers.

The method 400 also includes positioning the first and second propellants 122, 124 in the sleeve 130, as at 404. In at least some embodiments, the first and second propellants 122, 124 both extend to an inner diameter of the sleeve 130. The first and second propellants 122, 124 may be axially abutting, with the first propellant 122 covering an entire end surface of the second propellant 124.

The method 400 may then include positioning the sleeve 130 with the first and second propellants 122, 124 therein, in a charge housing 110, as at 406. The charge housing 110 may be connected to a piston housing 112, which may have a slidable piston 150 residing therein.

The method 400 may include connecting an igniter assembly 102 or 300 to the charge housing 110, as at 408. The igniter assembly 102 or 300 may include an electric igniter, e.g., the igniter 114 or the electrically-resistive element 306. At least a portion of the sleeve 130 and the first and second propellants 122, 124 (collectively, the charge 120) may be positioned axially between the igniter assembly 102 and/or 300 and the piston 150.

The setting tool 100 (e.g., including at least the igniter assembly 102, the charge assembly 104, and the piston assembly 106) may then be deployed into a well as part of a tool string, including a downhole tool, as at 410. Once the downhole tool reaches a desired location in the well, the method 400 may include igniting the first propellant 122 by applying an electrical current to the igniter assembly 102 and/or 300, as at 412. Igniting the first propellant 122 causes the first propellant 122 to combust, which in turn causes the second propellant 124 to combust. The first propellant 122 (particularly an oxidizing agent therein) is configured to combust more quickly than the second propellant 124 (particularly an oxidizing agent therein), and may be more easily ignited by the ignition assembly 102 and/or 300. The second propellant 124 may be slower combusting and may make up at least a majority of the volume of the sleeve 130. Thus, combusting the second propellant 124 generates a pressure differential across the piston 150 over a predetermined amount of time, which causes the piston 150 to move and thereby actuate a downhole tool.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An actuator for setting a downhole tool, the actuator comprising:

a first propellant configured to be ignited by an igniter, wherein the first propellant comprises a first carbon source; and a second propellant configured to be ignited by combustion of the first propellant, the first propellant abutting the second propellant such that the first propellant covers an axial end of the second propellant, wherein the first propellant is configured to combust more quickly than the second propellant, wherein the second propellant comprises a second carbon source, wherein the first and second carbon sources are different, at least one of the first carbon source and the second carbon source are fibrous, and wherein the actuator is connected to the downhole tool.

2. The actuator of claim 1, wherein the first propellant comprises a first weight percentage of an oxidizing agent, and wherein the second propellant comprises a second weight percentage of an oxidizing agent, the first weight percentage being greater than or equal to the second weight percentage.

3. The actuator of claim 2, wherein the oxidizing agent of the first propellant is configured to ignite more rapidly than the oxidizing agent of the second propellant.

4. The actuator of claim 1, further comprising a sleeve in which the first and second propellants are positioned, the first and second propellants being pressed axially together within the sleeve, the first and second propellants each extending to an inner diameter surface of the sleeve.

5. The actuator of claim 4, wherein the first propellant is visible from a first end of the sleeve and the second propellant is not visible from the first end, and wherein the second propellant is visible from a second end of the sleeve, and the first propellant is not visible from the second end.

6. The actuator of claim 4, wherein the first propellant is configured to block a flame generated by operation of the igniter from reaching the second propellant.

7. The actuator of claim 4, further comprising a charge housing that is connected to the igniter, wherein the sleeve and the first and second propellants are positioned in the charge housing, and wherein, when initiated, the igniter fires a flame into the charge housing that ignites the first propellant.

8. The actuator of claim 4, wherein the sleeve comprises a plurality of circumferentially-wrapped layers having axially-extending seams, the axially-extending seams of adjacent layers being circumferentially offset from one another.

9. The actuator of claim 1, wherein the igniter comprises an electrically-resistive heating element that is in direct contact with the first propellant.

10. The actuator of claim 1, wherein the first propellant and the second propellant occupy a volume, the second propellant occupying from about 80% to about 99% of the volume.

11. The actuator of claim 1, further comprising a piston, wherein igniting the first and second propellants generates a pressure differential across the piston that causes the piston to move and set the downhole tool.

12. The actuator of claim 11, further comprising an igniter comprising:

a sleeve at least partially filled with a charge;

a head threaded into connection with the sleeve and extending radially outward therefrom;

an insulator tube received through the head into the sleeve;

a conductor received through the insulator tube and including a shoulder that is too large to fit through the insulator tube;

a resistor positioned in the sleeve and electrically connected to the conductor and to the sleeve, so as to form an electrical path from the conductor to the sleeve, wherein current conducted to the sleeve is conducted therefrom to ground;

a seal positioned between the head and the shoulder;

a circlip coupled to the conductor, the circlip being sized such that the circlip bears against and does not proceed through the insulator tube; and a cap positioned on an end of the sleeve, wherein at least the cap and the head cooperate to contain the charge within the sleeve.

13. The actuator of claim 1, wherein an oxidizing agent in the first propellant has a greater percentage by weight than an oxidizing agent in the second propellant, wherein the oxidizing agent in the first propellant comprises from about 60 wt % to about 90 wt % potassium perchlorate, and wherein the oxidizing agent in the second propellant comprises from about 50 wt % to about 80 wt % potassium nitrate.

14. The actuator of claim 1, further comprising a charge housing having the first propellant, the second propellant, or both therein, wherein the charge housing defines a radial pressure port having a plug therein, and wherein the plug is configured to be removed from the pressure port to relieve pressure within the charge housing after the first and second propellants have been combusted in a well and after the actuator is removed from a well.

15. The actuator of claim 1, further comprising a charge housing having the first propellant, the second propellant, or both therein, wherein the charge housing defines a radial pressure port having a valve therein, and wherein the valve comprises a one-way valve that vents gas from within the charge housing in the well in response to combustion of the first and second propellants.

16. The actuator of claim 1, wherein the first propellent entirely covers an axial end of the second propellant, such that a flame emitted by the igniter reaches the first propellant and is prevented from directly impinging upon the second propellent.

17. A method comprising:

igniting a first propellant by applying an electrical current to an igniter, wherein igniting the first propellant causes the first propellant to combust, which causes a second propellant to combust to actuate a downhole tool, wherein the first propellant covers an axial end of the second propellant wherein the first propellant is configured to combust more quickly than the second propellant, wherein the first propellant comprises a first carbon source, wherein the second propellant comprises a second carbon source, wherein the first and second carbon sources are different, and wherein the first carbon source, the second carbon source, or both are fibrous.

18. The method of claim 17, wherein the igniter comprises an electrically-resistive heating element, the method further comprising connecting the heating element directly to the first propellant such that the first propellant is ignited without using a flame from the igniter to cause ignition, wherein applying the electrical current to the igniter causes the heating element to ignite the first propellant.

19. The method of claim 17, wherein applying the electrical current to the igniter causes the igniter to emit a flame that impinges on the first propellant, wherein the first propellant covering the axial end of the second propellant blocks the flame from reaching the second propellant.

20. The method of claim 17, wherein combusting the second propellant generates a pressure differential cross a piston, which causes the piston to move and thereby actuate the downhole tool.

21. The method of claim 17, further comprising positioning the first and second propellants in a cylindrical sleeve, the first and second propellants both extending to an inner diameter of the sleeve.

22. The method of claim 21, further comprising forming the sleeve by wrapping a plurality of layers circumferentially such that seams of the plurality of layers are axially extending, wherein the seams of radially-adjacent layers are circumferentially offset from one another.

23. The method of claim 21, wherein the second propellant occupies between about 80% and about 95% of a volume of the sleeve, and wherein the first propellant occupies between about 5% and about 20% of the volume of the sleeve.

24. A setting tool for actuating a downhole tool, comprising:

a charge assembly comprising:

a charge housing;

a cylindrical sleeve positioned in the charge housing;

a first propellant positioned in the cylindrical sleeve and having an outer diameter surface that contacts an inner diameter surface of the cylindrical sleeve; and a second propellant positioned in the cylindrical sleeve and having an outer diameter surface that contacts the inner diameter surface of the cylindrical sleeve, wherein the first propellant entirely covers an end surface of the second propellant, wherein the first propellant is positioned axially between an igniter and the second propellant wherein the second propellant occupies a greater volume than the first propellant occupies, and wherein the first propellant is configured to combust more rapidly than the second propellant wherein the first propellant comprises a first carbon source, wherein the second propellant comprises a second carbon source, wherein the first and second carbon sources are different, and wherein the first carbon source, the second carbon source, or both are fibrous; and a piston assembly comprising a piston that is configured to slide in response to a pressure applied by combustion of at least the second propellant to actuate the downhole tool.

25. The setting tool of claim 24, further comprising the igniter, the igniter comprising:

an igniter housing having a flame port, wherein the charge housing is coupled to the igniter housing; and an igniter positioned in the igniter housing, the igniter configured to generate the flame that is directed out of the igniter housing via the flame port.

* * * * *